US012790661B2

(12) United States Patent
Degel et al.

(10) Patent No.: US 12,790,661 B2
(45) Date of Patent: Nov. 10, 2026

(54) METHOD FOR OBTAINING NON-FERROUS METALS, IN PARTICULAR BLACK AND/OR RAW COPPER, FROM SCRAP CONTAINING ORGANIC MATTER

(71) Applicant: SMS group GmbH, Düsseldorf (DE)

(72) Inventors: Rolf Degel, Ratingen (DE); Timm Lux, Meerbusch (DE); Frank Marlin Kaussen, Aachen (DE); Nikolaus Peter Kurt Borowski, Düsseldorf (DE)

(73) Assignee: SMS group GmbH, Düsseldorf (DE)

( * ) Notice: Subject to any disclaimer, the term of this patent is extended or adjusted under 35 U.S.C. 154(b) by 728 days.

(21) Appl. No.: 18/015,798

(22) PCT Filed: Jun. 17, 2021

(86) PCT No.: PCT/EP2021/066456
§ 371 (c)(1),
(2) Date: Jan. 12, 2023

(87) PCT Pub. No.: WO2022/012851
PCT Pub. Date: Jan. 20, 2022

(65) Prior Publication Data

US 2023/0272507 A1 Aug. 31, 2023

(30) Foreign Application Priority Data

Jul. 14, 2020 (DE) ..... 10 2020 208 774.1

(51) Int. Cl.
*C22B 15/00* (2006.01)
*C22B 7/00* (2006.01)

(52) U.S. Cl.
CPC ..... *C22B 15/0056* (2013.01); *C22B 7/003* (2013.01); *C22B 15/0052* (2013.01)

(58) Field of Classification Search
CPC . C22B 15/0056; C22B 7/003; C22B 15/0052; C22B 7/004; C22B 15/006; C22B 5/10; Y02P 10/20
(Continued)

(56) References Cited

U.S. PATENT DOCUMENTS 3,664,828 A 5/1972 Worner
4,415,360 A 11/1983 Leirnes et al.
(Continued)

FOREIGN PATENT DOCUMENTS

CA 3085071 A1 6/2019
CN 105349787 2/2016
(Continued)

OTHER PUBLICATIONS

JP2018528322A (machine translation) (Year: 2018).*
(Continued)

*Primary Examiner* — Danielle M. Carda
*Assistant Examiner* — Nazmun Nahar Shams
(74) *Attorney, Agent, or Firm* — Smartpat PLC

(57) ABSTRACT

A method for obtaining non-ferrous metals, in particular black and/or raw copper, from scrap containing organic matter, comprises the following steps: i) providing a melting reactor, wherein the melting reactor includes a melting region, a combustion region and a pyrolysis region; ii) supplying the melting reactor with a mixture comprising the scrap such that it first passes through the pyrolysis region and the combustion region before it reaches the melting region, and is at least partially pre-pyrolyzed and/or combusted, such that an energy-containing gas stream is formed; iii) transferring the energy-containing gas stream into a thermal post-combustion chamber, in which the energy-containing gas stream is completely combusted and thermal energy released during combustion is carried off via an
(Continued)

energy recovery unit; and iv) melting the scrap containing organic matter at least part of which has been pre-pyrolized and/or combusted.

12 Claims, 1 Drawing Sheet

(58) Field of Classification Search
USPC ..... 75/646
See application file for complete search history.

(56) References Cited

U.S. PATENT DOCUMENTS

| | | | | |
|---|---|---|---|---|
| 4,606,760 | A | 8/1986 | Fritz et al. | |
| 4,705,562 | A | 11/1987 | Hedlund | |
| 4,740,240 | A | 4/1988 | Sulzbacher et al. | |
| 4,961,784 | A | 10/1990 | Tanabe et al. | |
| 2005/0284261 | A1 | 12/2005 | Sandberg | |
| 2009/0005630 | A1* | 1/2009 | Yokoyama | F23G 5/027 588/412 |
| 2017/0198371 | A1 | 7/2017 | Ayhan et al. | |
| 2018/0274058 | A1 | 9/2018 | Filzwieser et al. | |
| 2021/0071282 | A1 | 3/2021 | Coletti et al. | |

FOREIGN PATENT DOCUMENTS

| | | | |
|---|---|---|---|
| CN | 105387469 | A | 3/2016 |
| CN | 108224433 | A | 6/2018 |
| CN | 110184462 | | 8/2019 |
| DE | 1146661 | B | 4/1963 |
| DE | 4201547 | A1 | 6/1992 |
| EP | 0070819 | A1 | 1/1983 |
| EP | 1609877 | A1 | 12/2005 |
| JP | H1015519 | A | 1/1998 |
| JP | 2001040431 | A | 2/2001 |
| JP | 2002168417 | A | 6/2002 |
| JP | 2005030662 | B | 12/2008 |
| JP | 2018528322 | A | 9/2018 |
| WO | 8605211 | A1 | 9/1986 |

OTHER PUBLICATIONS

"Nitrogen Oxides (NOx) Emissions" a publication form National Energy Technology Laboratory of Department of Energy, USA, ( Year: 2025).*

Alvear Flores, Gerardo RF, Stanko Nikolic, and Phillip J. Mackey. "ISASMELT™ for the recycling of E-scrap and copper in the US case study example of a new compact recycling plant." Jom 66, No. 5 (2014): 823-832.

* cited by examiner

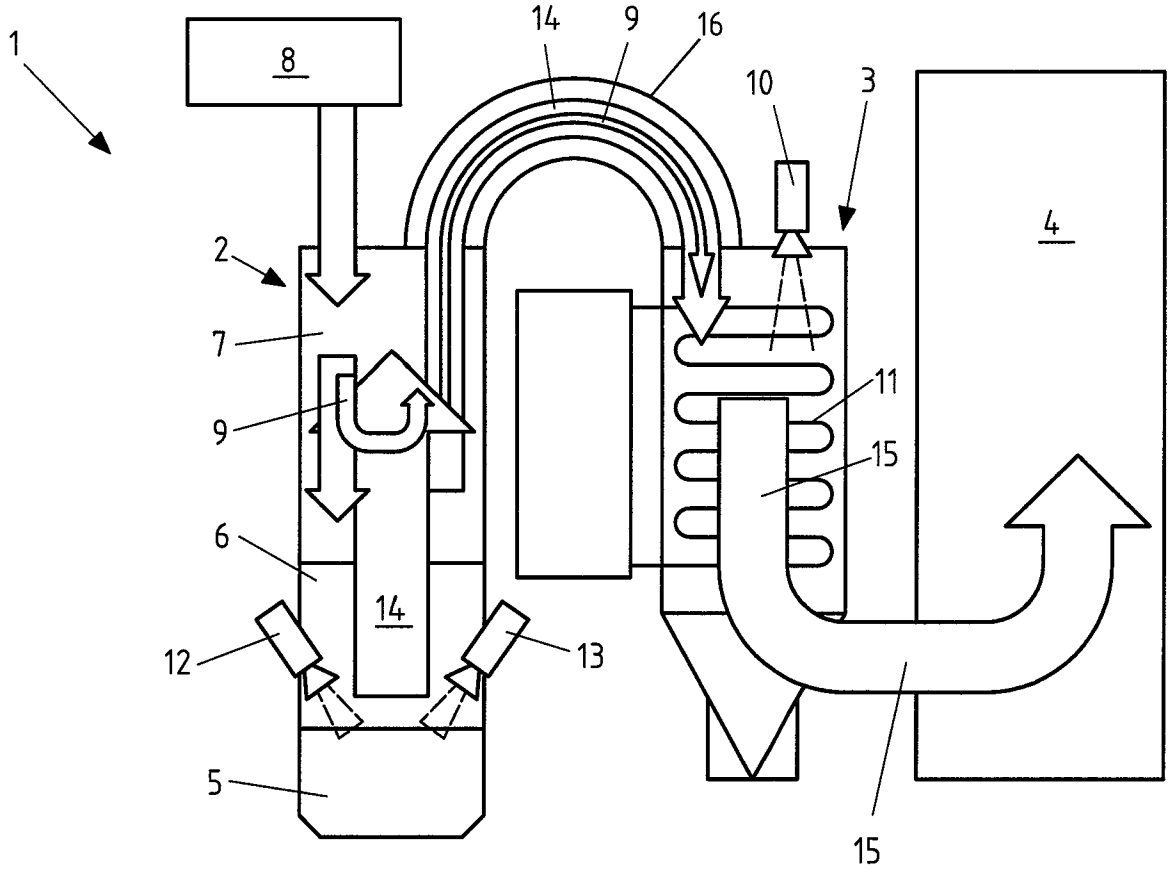
1
2
3
4
5
6
7
8
9
9
10
11
12
13
14
14
15
15
16

METHOD FOR OBTAINING NON-FERROUS METALS, IN PARTICULAR BLACK AND/OR RAW COPPER, FROM SCRAP CONTAINING ORGANIC MATTER

TECHNICAL FIELD

The present disclosure relates to a method and to a plant for obtaining non-ferrous metals, in particular black and/or raw copper, from scrap containing organic matter.

BACKGROUND

In principle, processes for the recovery of recyclable materials from scrap are known from the state of the art.

For example, the European patent application EP 1 609 877 A1 discloses a method for the processing in batches of metal-containing residual materials, such as in particular electronic scrap, in a rotating reactor. The feed material, i.e. in particular the electronic scrap, consists substantially of fractions of such size as to permit continuous loading during operation. In the reactor, the material is melted down to produce a processed product that is substantially free of any organic matter because the original organic fraction of the feed material burns off during the melting down.

Furthermore, EP 0 070 819 B1 discloses a method for converting metal-containing waste products with a high fraction of organic substances, such as cable waste and waste from electronic equipment, into a product from which a valuable metal can be easily obtained. For this purpose, the waste products are added into a rotating reactor vessel and then heated in order to expel the organic components in the form of a combustible gas, which is then combusted outside the reactor vessel.

Another method for recycling copper-containing electronic scraps is disclosed in the paper by Gerardo et al., ISASMELT™ for the Recycling of E-Scrap and Copper in the U.S. Case Study Example of a New Compact Recycling Plant, The Minerals, Metals & Materials Society, DOI 10.1007/s11837-014-0905-3.

SUMMARY

The present disclosure is based on the object of providing an improved method and an improved plant that for obtaining non-ferrous metals, in particular black and/or raw copper, from scrap containing organic matter.

This object is achieved by a method and by a plant as disclosed and claimed.

Advantageous embodiments of the invention are indicated in the dependent formulated claims. The features listed individually in the dependent formulated claims can be combined with one another in a technologically useful manner and can define further embodiments. In addition, the features indicated in the claims are further specified and explained in the description, wherein further preferred embodiments of the invention are illustrated.

The method for obtaining non-ferrous metals, in particular black and/or raw copper, from scrap containing organic matter, comprises the steps of:

i) providing a melting reactor, wherein the melting reactor is configured such that it has at least one melting region, a combustion region and a pyrolysis region, ii) supplying the melting reactor with a mixture comprising the scrap containing organic matter such that said scrap containing organic matter first passes through the pyrolysis region and the combustion region before it reaches the melting region, and is at least partially pre-pyrolyzed and/or combusted such that an energy-containing gas stream is formed, iii) transferring the energy-containing gas stream to a thermal post-combustion chamber, in which the energy-containing gas stream is completely combusted and the thermal energy released during combustion is carried off via an energy recovery unit; and iv) melting the scrap containing organic matter at least part of which has been pre-pyrolized and/or combusted.

The present disclosure is based on the essential finding that the melting of high-energy scrap, which is characterized by a high organic fraction, introduces a very high energy input into the melting process, which severely attacks the melting reactor or plant, leads to increased wear and to a large extent leaves unused with the exhaust gas. The specific method approach in accordance with the disclosure enables the unused excess energy to be recovered in a targeted manner and the entire recycling process to be optimized in terms of energy. Furthermore, the wear of the melting reactor or the plant is reduced.

The melting reactor is supplied with the mixture comprising the scrap containing organic matter in such a manner that it first passes through the pyrolysis region and the combustion region before its reaches the melting region and is at least partially pre-pyrolyzed and/or combusted. The energy-containing gas stream formed in this process is then transferred directly to a thermal post-combustion chamber where it is completely combusted. This results in a lower energy input in the melt, which has a beneficial effect on the regulation of the melting process. The heat energy released in the post-combustion is carried off via the energy recovery unit, which preferably comprises an evaporator or a heat exchanger, and can be used, for example, to generate saturated steam or $CO_2$-neutral electrical energy.

The temperature in the pyrolysis region has at least 180° C., preferably at least 420° C., more preferably at least 800° C., and most preferably at least 900° C. Too low a temperature has a detrimental effect on the desired pyrolysis process, since too low a fraction of the organic component of the scrap used is pyrolyzed and consequently too high an organic fraction reaches the melt. However, the temperature must not exceed a maximum temperature, since a specific fraction of the organic component is required as a fuel for the melt in order to be able to operate the recycling process in the optimum range in terms of energy. The temperature must also not be too high, due to the nature of the melting reactor, as this would lead to undesirable wear of the melting reactor. Advantageously, the maximum temperature therefore amounts to 1500° C., preferably 1400° C., more preferably 1300° C., and most preferably a maximum of 1200° C.

Advantageously, the scrap containing organic matter is fed to the melting reactor in countercurrent to the energy-charged inert gas stream. This slows down the fall velocity of the individual particles, since the gas stream flows around them. In principle, when looking at individual particles, they should be relatively easy to heat in order to easily release the pyrolysis gases. For example, too short a dwell time would have a detrimental effect on the desired pyrolysis process, since too low a fraction of the organic component would be pyrolyzed and consequently too high an organic content would reach the melt. On the other hand, however, the dwell time should not exceed a maximum time, since a specific fraction of the organic component is required as a fuel for the melt in order to be able to operate the recycling process in the optimum range in terms of energy.

In a particularly advantageous design variant, the melt is selectively cooled by feeding an inert gas, preferably nitrogen, into the combustion and/or melting region, forming an energy-charged inert gas stream. In this connection, it is particularly advantageous that such energy-charged inert gas stream transfers the energy-containing gas stream formed in the upper part of the melting reactor to the thermal post-combustion chamber. On the one hand, this ensures that the melting process can be optimally adjusted and regulated. On the other hand, the thermal energy released in the melting process is almost completely recovered.

If nitrogen is used as an inert gas for targeted cooling, $NO_x$ compounds may be formed, depending on the temperature in the melting reactor. In order to reduce the formation of $NO_x$ compounds, the temperature in the melting reactor can be adjusted in such a manner that the pyrolysis region does not exceed a temperature of 1200° C. at the maximum. Alternatively, the $NO_x$ compounds can be reduced in a catalytic SCR unit, for example downstream of the post-combustion chamber.

The method is intended for the pyrometallurgical processing of scrap containing organic matter. Within the meaning of the present disclosure, scrap containing organic matter is understood to be any scrap comprising an organic component. Preferred scrap containing organic matter is selected from the series comprising electronic scrap, auto shredder scrap and/or transformer shredder scrap, in particular shredder light fractions and/or mixtures thereof.

Within the meaning of the present disclosure, the term "electronic scrap" is understood to mean waste electronic equipment as defined in accordance with EU Directive 2002/96/EC. Categories of equipment covered by this Directive concern whole and/or (partially) disassembled large household appliances; small household appliances; IT and telecommunication equipment; consumer electronics equipment; lighting equipment; electrical and electronic tools (with the exception of large-scale stationary industrial tools); electrical toys and sports and leisure equipment; medical devices (with the exception of all implanted and infected products); monitoring and control instruments; and automatic dispensers. With regard to the individual products that fall into the corresponding category of equipment, reference is made to Annex IB of the Directive.

Such electronic scrap substantially comprises hydrocarbon-containing components, such as plastics in particular, along with metallic components, such as in particular the elements selected from the series comprising copper, nickel, lead, tin, zinc, gold, silver, antimony, palladium, indium, gallium, rhenium, titanium, aluminum and/or yttrium.

Thereby, the electronic scrap of the mixture is configured in such a manner that it preferably contains an aluminum content of at least 0.1 wt %, more preferably an aluminum content of at least 0.5 wt %, even more preferably an aluminum content of at least 1.0 wt % and most preferably an aluminum content of at least 3.0 wt %. With regard to the maximum content, electronic scrap is limited, since an excessively high aluminum content has a detrimental effect on the viscosity and thus the flowability of the slag phase as well as on the separation behavior between the metallic phase and the slag phase. Therefore, the electronic scrap preferably contains at most 20 wt % aluminum, more preferably at most 15 wt % aluminum, even more preferably at most 11 wt % aluminum and most preferably at most 8 wt % aluminum.

The charging and thus the energy input into the melting reactor can be uneven due to different particle sizes and, in particular, due to excessively large particle sizes, so that undesirable conditions are formed during the smelting process. Therefore, electronic scrap is preferably fed in crushed form. Advantageously, the electronic scrap is crushed to a particle size smaller than 20.0 inches, more preferably to a particle size smaller than 15.0 inches, even more preferably to a particle size smaller than 12.0 inches, further preferably to a particle size smaller than 10.0 inches, further preferably to a particle size smaller than 5.0 inches, and most preferably to a particle size smaller than 2.0 inches. However, the particle size should not be less than 0.1 inch, preferably a particle size of 0.5 inch, more preferably a particle size of 1.5 inch.

The mixture comprising the scrap containing organic matter can comprise a defined organic content. However, the content of the hydrocarbon-containing components must not be too small; otherwise, a sufficient pyrolysis and/or combustion reaction will not occur. Therefore, the fraction of the hydrocarbon-containing component is preferably at least 10 wt %, more preferably at least 15 wt %, most preferably 20 wt %. With regard to the maximum content, the organic-containing scrap of the mixture is limited and is therefore preferably a maximum of 98 wt %, more preferably a maximum of 90 wt %, even more preferably a maximum of 80 wt %, further preferably a maximum of 70 wt % and most preferably a maximum of 60 wt %.

Advantageously, step ii) of the method is assisted by selective injection of an oxygen-containing gas. As such, the reaction is adjusted in such a manner that complete combustion of the hydrocarbons to $CO_2$ and $H_2O$ does not occur, but contents of CO, $H_2$ are also formed in the process gas. This allows the combustion of the organic components to be selectively controlled, with the thermal energy released in the process assisting step iv) of the process.

The exhaust gas stream formed in the thermal post-combustion chamber is then fed to a catalytic SCR unit and/or a filter device.

In an additional aspect, the present disclosure further relates to a plant for obtaining non-ferrous metals, in particular black and/or raw copper, from scrap containing organic matter. The plant comprises:

i) a melting reactor, wherein the melting reactor is configured to include at least one melting region, a combustion region and a pyrolysis region,
ii) a thermal post-combustion chamber in which an energy-containing gas stream is fully combustible; and
iii) an energy recovery unit through which thermal energy released during combustion can be carried off.

The melting reactor is preferably a metallurgical vessel, such as, for example, a shaft furnace, a bath melting reactor, a Peirce-Smith converter or a tiltable rotary converter, in particular a so-called top-blown rotary converter (TBRC), or a tiltable stand-alone converter. In an advantageous design variant, the metallurgical vessel comprises a first tap opening for tapping the metallic phase and/or a second tap opening for tapping the slag phase. Thereby, the tapping opening for tapping the metallic phase is advantageously arranged in the bottom and/or in the side wall of the corresponding melting reactor, so that it can be removed via this.

For feeding the oxygen-containing gas and/or the inert gas, preferably nitrogen, the melting reactor preferably comprises at least one or more injectors arranged at the level of the combustion region and/or the melting region.

Furthermore, the plant advantageously comprises a catalytic SCR unit and/or a filter device arranged downstream of the post-combustion chamber.

The invention and the technical environment are explained in more detail below with reference to figures and examples. It should be noted that the invention is not meant to be limited by the exemplary embodiments shown. In particular, unless explicitly shown otherwise, it is also possible to extract partial aspects of the facts explained in the figures and combine them with other components and findings from the present description and/or figures. In particular, it should be noted that the figures and especially the size relationships shown are only schematic. Identical reference signs designate identical objects, such that explanations from other figures can be used as a supplement if necessary.

BRIEF DESCRIPTION OF THE DRAWINGS

FIG. 1 is a highly simplified schematic illustration of a design variant of a plant for obtaining non-ferrous metals from scrap, on the basis of which the method for obtaining non-ferrous metals from scrap is explained.

DETAILED DESCRIPTION

The plant 1 is formed to carry out the method for the recovery of black and/or raw copper from scrap containing organic matter, wherein fractions of silver (Ag), gold (Au), platinum (Pt) and palladium (Pd) can also be obtained.

The plant 1 comprises a melting reactor 2, a thermal post-combustion chamber 3 and a filter device 4. In the present case, the melting reactor 2 is designed in the form of a shaft furnace and has a melting region 5, a combustion region 6 along with a pyrolysis region 7.

In a first process step, a crushed mixture of 100 wt % of a scrap containing organic matter 8 of a shredder light fraction (SLF) is first fed into the melting reactor 2 through an opening above (not shown). Thereby, the crushed scrap containing organic matter 8 has an average particle size of 1.0 to 5.0 inches, wherein smaller particle sizes and/or dusts are unavoidable due to the process and may therefore be included.

The scrap containing organic matter 8 fed to the melting reactor 2 first passes through the pyrolysis section 7 along with the combustion section 6. The temperature in the pyrolysis region 7 is in the range of 900° to 1200° C. Of the scrap containing organic matter 8 that is added to the melting reactor, a fraction of 10-50 wt % of the organic component is pyrolyzed in the pyrolysis region 7 and an energy-containing gas stream 9 is formed. As shown in FIG. 1, this is then fed to the thermal post-combustion chamber 3 and completely combusted using a burner 10, wherein the thermal energy released during combustion is carried off via an energy recovery unit 11, which comprises an evaporator. Advantageously, hydrogen that has been produced from renewable energy sources (a so-called "green hydrogen") is used as a fuel for the burner 10.

The at least partially pre-pyrolyzed and/or combusted scrap containing organic matter 8 is then melted down in the melting reactor 2. The combustion reaction can be specifically controlled in this case by the addition of oxygen, which is fed to the melting reactor 2 via an oxygen injector 12. The volume flow of oxygen is adjusted in such a manner that a reducing atmosphere always prevails at the surface of the melt and complete combustion of the organic fraction to $CO_2$ and $H_2O$ does not take place; rather, specific contents of CO along with $H_2$ are present in the process gas, which are also fed to the thermal post-combustion chamber 3 and combusted.

Furthermore, an inert gas, such as nitrogen, can be selectively introduced into the combustion and/or the melting region 5, 6 via the injector 12. This cools the melt and forms an energy-charged inert gas stream 14. As shown by the schematic illustration, the energy-charged inert gas stream 14 transfers the energy-containing gas stream 9 formed in the upper part of the melting reactor 2 through a duct 16 to the thermal post-combustion chamber 3. The exhaust gas stream 15 formed in the thermal post-combustion chamber 3 is then fed to the filter device 4.

LIST OF REFERENCE SIGNS

1 Plant
2 Melting reactor
3 Thermal post-combustion chamber
4 Filter device
5 Melting region
6 Combustion region
7 Pyrolysis region
8 Electronic scrap
9 Energy-containing gas stream
10 Burner
11 Heat exchanger
12 Injector
13 Inert gas stream
14 Exhaust gas
15 Exhaust gas stream
16 Duct

The invention claimed is:

1. A method for obtaining non-ferrous metals from scrap containing organic matter (8), comprising the following steps:

providing a melting reactor (2), wherein the melting reactor (2) is configured such that it has a melting region (5), a combustion region (6), and a pyrolysis region (7);

supplying a mixture comprising the scrap containing organic matter (8) into the melting reactor (2) such that it first passes through the pyrolysis region (7) and the combustion region (6) before it reaches the melting region (5), wherein the mixture has an organic content of at least 10 wt %;

at least partially pyrolyzing the mixture in the pyrolysis region (7) and/or at least partially combusting the mixture in the combustion region (6) such that an energy-containing gas stream (9) is formed before the mixture reaches the melting region (5);

transferring the energy-containing gas stream (9) from the melting reactor (2) through a duct (16) into a thermal post-combustion chamber (3), in which the energy-containing gas stream (9) is completely combusted and thermal energy released during combustion is carried off via an energy recovery unit (11); and melting the mixture in the melting region (5) to produce a melt.

2. The method according to claim 1, wherein the melt is cooled by feeding an inert gas into the combustion and/or melting region (5, 6) forming an energy-charged inert gas stream (14).

3. The method according to claim 2, wherein the energy-containing gas stream (9) is transferred into the thermal post-combustion chamber (3) by the energy-charged inert gas stream (14).

4. The method according to claim 2, wherein the scrap containing organic matter (8) is fed to the melting reactor (2) in countercurrent to the energy-charged inert gas stream (14).

5. The method according to claim 1, wherein the pyrolysis region (7) has a temperature of at least 180° C.

6. The method according to claim 1, wherein the pyrolysis region (7) has a temperature of at least 900° C.

7. The method according to claim 1, wherein the scrap containing organic matter (8) is fed into the pyrolysis region (7) in crushed form.

8. The method according to claim 1, wherein an exhaust gas stream (15) formed in the thermal post-combustion chamber (3) is fed to a filter device (4).

9. The method according to claim 1, wherein at least partially combusting the mixture in the combustion region (6) is assisted by injecting an oxygen-containing gas.

10. The method according to claim 1, further comprising: using the thermal energy carried off via an energy recovery unit (11) for generating saturated steam.

11. The method according to claim 1, further comprising: using the thermal energy carried off via an energy recovery unit (11) for generating electrical energy.

12. The method according to claim 1, further comprising: feeding an exhaust gas stream from the thermal post-combustion chamber to a catalytic SCR unit or a filter device.

* * * * *